US005111673A

United States Patent [19]

Kadoya et al.

[11] Patent Number: 5,111,673

[45] Date of Patent: May 12, 1992

[54] WASHING-DRYING MACHINE

[75] Inventors: Katsuhiko Kadoya, Kishiwada; Yukinobu Omichi, Ikoma; Eiji Matsuda, Katano; Kenji Takenaka, Minou, all of Japan

[73] Assignee: Matsushita Electric Industrial Co. Ltd., Kadoma, Japan

[21] Appl. No.: 726,126

[22] Filed: Jul. 3, 1991

Related U.S. Application Data

[63] Continuation of Ser. No. 465,150, filed as PCT/JP89/00598, Jun. 15, 1989, abandoned.

[30] Foreign Application Priority Data

| | | | |
|---|---|---|---|
| Sep. 29, 1988 | [JP] | Japan | 63-244913 |
| Nov. 24, 1988 | [JP] | Japan | 63-296468 |
| Mar. 15, 1989 | [JP] | Japan | 1-62448 |
| Mar. 15, 1989 | [JP] | Japan | 1-62450 |
| Jun. 15, 1989 | [JP] | Japan | 63-152628 |

[51] Int. Cl.[5] ..... D06F 25/00; D06F 33/02; D06F 37/20

[52] U.S. Cl. ..... 68/12.04; 68/12.05; 68/12.14; 68/19.2; 68/20; 68/25

[58] Field of Search ..... 68/12.04, 12.05, 12.14, 68/19.2, 20, 25

[56] References Cited

U.S. PATENT DOCUMENTS

| | | | |
|---|---|---|---|
| 2,579,310 | 12/1951 | Dunham | 68/25 |
| 2,782,622 | 2/1957 | Candor | 68/20 X |
| 2,881,609 | 4/1959 | Brucken | 68/19.2 |

FOREIGN PATENT DOCUMENTS

| | | |
|---|---|---|
| 61-205482 | 12/1986 | Japan . |
| 62-22688 | 1/1987 | Japan . |

*Primary Examiner*—Philip R. Coe
*Attorney, Agent, or Firm*—Cushman, Darby & Cushman

[57] ABSTRACT

A washing-drying machine wherein a tub is mounted in a prism-shaped housing by a pair of tilting shafts in order to carry out the washing-rinsing-spinning steps with a tub substantially vertical and to carry out the warm-air drying step with a tub substantially horizontal. The tilting shafts are arranged on a horizontal axis extending through diagonally opposite corners of the housing so that the capacity of the tub can be maximized, even through the tub tilts, and thereby the capacity of the housing can be efficiently utilized.

3 Claims, 12 Drawing Sheets

18A--- Water tub A
22 --- Water outlet

WASHING-DRYING MACHINE

This is a continuation of Application Ser. No. 07/465,150, filed as PCT/JP89/00598, Jun. 15, 1989, which was abandoned upon the filling hereof.

TECHNICAL FIELD

This invention relates to a washing-drying machine which can continuously carry out the stepes of from washing, rinsing, spinning to drying.

BACKGROUND ART

Conventionally, as for a washing-drying machine, such designed one as shown in FIG. 14 and FIG. 15 has been devised. That is, a water tub 2, i.e. a tub to hold water, is tiltably supported by a horizontal shaft 3 in a washing-drying machine main body or housing 1, wherein a rotary drum 4 is rotatably supported with a rotary shaft 5 within the water tub 2. A drive switching device 6 for switching to a pulsator or to the rotary drum 4 and an electric motor 7*a* for driving the rotary shaft 5 are arranged at the under part of the water tub 2. The rotary shaft 5 and the electric motor 7*a* are connected by a belt. In the vicinity of the end part of the horizontal shaft 3, a displacement electric motor 7*b* is secured to a main body 1, whereby a pinion gear 9 meshing with a worm gear 8 which is driven by the displacement electric motor 7*b* is secured to the horizontal shaft 3. When the worm gear 8 rotates, the pinion gear 9 is driven, whereby the horizontal shaft 3 rotates to tilt the water tub 2 around the horizontal shaft 3. At the outside of the under part of the water tub 2, a fan 10 to be used during the drying step is connected to a duct 12 through a heater 11, and the duct 12 communicates with the interior of the water tub 2. The numeral 13 designates a water outlet.

In the above-mentioned construction, the laundry is put in the water tub 2 and the machine is turned on. The washing-rinsing-spinning step is carried out in the verticl state of the water tub 2 as shown by solid lines in FIG. 14 and FIG. 15, and, after finishing the final spinning step, the displacement electric motor 7b, and hence the worm gear 8, drives the pinion gear 9, which tilts the water tub 2 into a horizontal posture, whereby the step proceeds to the drying one. This state is shown by the two-dot chain lines in FIG. 14. During the drying step, the rotary drum 4 is rotated, and the fan 10 and the heater 11 are powered to carry out the drying step.

As for the washing-drying machine of the above-mentioned design, since the horizontal shaft 3 for tilting the water tub 2 is arranged at the outside of the water tub 2 and the front and rear direction of the main body 1, the bottom area of the main body 1 is increased; and hence in order to make the same size as a washing-drying machine of conventional ones, the size of the water tub 2 has to be decreased and thus the washable-dryable laundry amount thereof is decreased.

Further, since the horizontal shaft 3 for supporting and tilting the water tub 2 is arranged at the side walls of the main body 1 and the water outlet 13 is arranged at the side wall, the orbit of the water outlet 13 during tilting of the water tub 2 becomes large, and the water tub 2 can not have sufficient capacity in the limited space of the main body 1, thereby problematically diminishing the washing-drying laundry amount. Though an arrangement of a horizontal shaft 3 at the cornering parts of the main body 1 has been invented, there is a problem that the orbits of the upper part and the bottom part of the cylindrical water tub 2 of the said machine during the tilting of the water tub 2 interfere the side walls of the main body 1, and the capacity of the water tub 2 can not be secured sufficiently.

Further, during drying of the laundry the air for drying is heated and blown into the water tub 2, and then the humid air after having dried the laundry is directly exhausted to the outside of the machine, and there arises a problem that the interior of the room becomes wet and the moisture is condensed into water on the wall surface. Though, on the other hand, a condensation type of a laundry drying machine provided with a heat-exchanger and a circular course of the air for drying may be proposed, in case of a washing-drying machine, during the washing it is necessary to contain water in the water tub, and it has a problem of injuring the reliability by encroaching of the water in the circular course, and besides, there is a problem of greatly complicating the circular course itself.

Moreover, since the machine probably carries out the drying step alone, instead of drying after the spinning step, and if the water remains in the water tub the water leaks out of the water tub snce the drying is made with the water tub in horizontal status, and this makes a problem in reliability.

Further, due to the capacity of the rotary drum, the dryable laundry amount is about a half of the washable-rinsable-spinable laundry amount; and the laundry amount exceeding that limit protracts the drying time, and badly forms uneven dryness and much wrinkles. Therefore, the user must judge whether he or she carries out only the washing-rinsing-spinning step or can continue until the drying step, in compliance with the laundry amount before starting the washing, and it is much inconvenient.

DISCLOSURE OF INVENTION

Therefore, a first object of the present invention is to obtain a tilting device for efficiently utilizing a main body capacity.

A second object is to obtain a water outlet and an overflow outlet for efficiently utilizing the main body capacity.

A third object is to obtain a construction of the water tub for efficiently utilizing the main body capacity.

A fourth object is to obtain a very reliable and simple construction of the drying device.

A fifth object is to obtain a high reliability free of water leakage under any running condition.

A sixth object is to detect the laundry amount before starting the drying step, and to properly judge whether operation until the drying step is possible, in order to convenience the user.

In order to accomplish the first object, the present invention provides a pair of tilting shafts for enabling tilting of a water tub at diagonal corners of a main body, whereby the tilting shafts are positioned at corner parts of a main body, thereby maximizing the water tub and efficiently utilize the capacity in the main body, even in case of the tilting of the water tub.

In order to accomplish the second object, the present invention provides a pair of tilting shafts at diagonal corners of a main body, arranges a water outlet so as to position it in the vicinity of corners of a main body when a water tub is tilted almost horizontally, and arranges an overflow outlet so as to position it in the vicinity of the corners of the main body when the water tub is uprighted almost vertically, whereby the orbits of the water outlet and the overflow outlet pass through the corner parts of the main body during the tilting of the water tub, thereby efficiently utilizing the main body capacity and enlarge the water tub.

In order to accomplish the third object, the present invention provides a pair of tilting shafts at diagonal corners of a main body, and render the water tub almost cylindrical shape having the upper and bottom parts thereof formed almost truncated-cones, whereby the orbit of the water tub during the tilting can be small, thereby enlarging the water tub.

In order to accomplish the fourth object, the present invention arranges a blowing-in port for introducing air for drying laundry into a water tub and an exhaust outlet of the water tub at the upper opening part thereof, whereby the water does not encroach the path of the drying air, thereby realizing reliable washing-drying machine free of electricity leakage and water leakage of a simple construction.

In order to accomplish the fifth object, the present invention has a controlling device which carries out washing-rinsing-spinning step in almost vertical state of a water tub and carries out the drying step in almost horizontal state of the water tub thereby spinning the laundry before starting of the driving of the tilting device, whereby the water does not leak and can offer a high reliability even when the water remains in the water tub before the tilting.

In order to accomplish the sixth object, the present invention has a laundry amount detecting means for detecting the laundry amount before the driving step and a controlling device which when detecting exceeding of laundry amount above a predetermined limit stops proceeding to the drying, whereby the user need not to judge whether it can carry out only the washing-rinsing-spinning step or can continue until the drying step in compliance with the laundry amount before starting the washing, thereby improving the conveniences greatly.

BEST MODE FOR CARRYING OUT THE INVENTION

Figure 5:
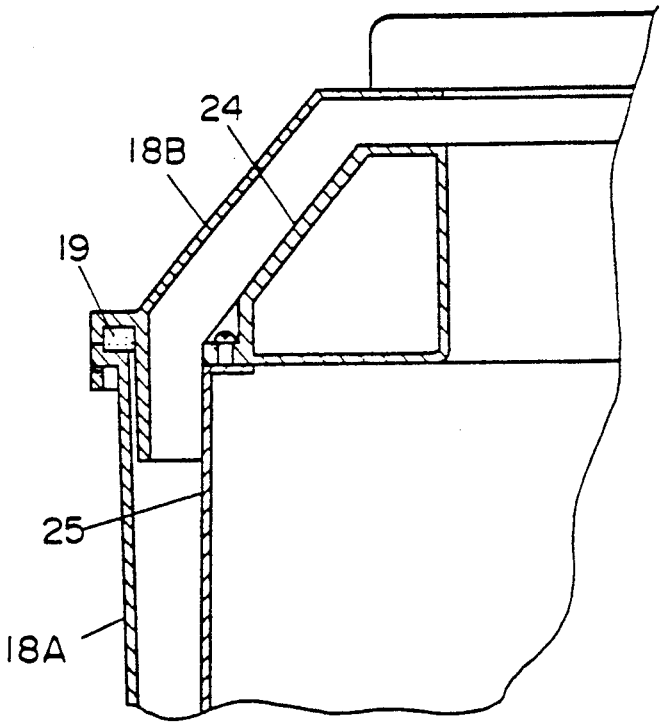
FIG. 5 is an enlarged sectional view showing a water tub part of the same.

Referring to the attached drawings, an embodiment of the present invention will be explained in the following. In FIG. 1 through FIG. 13, numeral 14 designates a prism-like main body or housing, and numeral 15 a main body having a laundry receiving opening 16 at its central upper part. Numeral 17 designates an openable outer lid for covering the laundry receiving opening 16, and numeral 18A a water tub whose lower part is formed reversely truncated-cone so as to enlarge the water tub capacity without interfering with the main body 14 during the tilting. Numeral 18B designates the upper part of water tub 18A that is formed truncated-cone so as to enlarge the water tub capacity without interfering with the main body 14 during the tilting. Numeral 19 designates a watertightening seal member which is arranged at the fitting part between the water tub 18A and the upper part 18B and the detail whereof is shown in FIG. 5. Numeral 20 designates an openable lid arranged centrally of the upper part 18B of the water tub 18A. Numeral 21 designates an overflow outlet which is positioned in the vicinity of a corner of the main body 14 for making the water overflow during the irrigating-rinsing, etc. Numeral 22 designates a water outlet for communicating with the overflow outlet 21 at the outside of the water tub 18A, which water outlet is arranged so as to be positioned in the vicinity of a corner of the main body 14 when the water tub is almost horizontal. Numeral 23 designates a remaining water detector which is arranged at the bottom part of the water tub 18A and consists of a pair of electrodes. The water tub 18A has therein a rotary drum 25 provided with water passing perforations, a balancer 24, and pulsator 26. The pulsator 26 is fitted on a washing shaft 28 of a mechanical part 27, and the rotary drum 25 is connected to a spinning shaft 29 of the mechanical part 27. Further, the spinning shaft 29 is timely connectable to and releasable from the washing shaft 28 by the above-mentioned mechanical part 27. Numeral 30 designates an input shaft of the mechanical part 27. The input shaft 30 comprises a mechanical pulley 31 and a mechanical pulley 32. Numeral 33 designates a washing electric motor, and numeral 34 a washing pulley provided to the washing electric motor 33, and the mechanical pulley 31 is linked with the washing pulley 34 with a belt 35.

Figure 6:
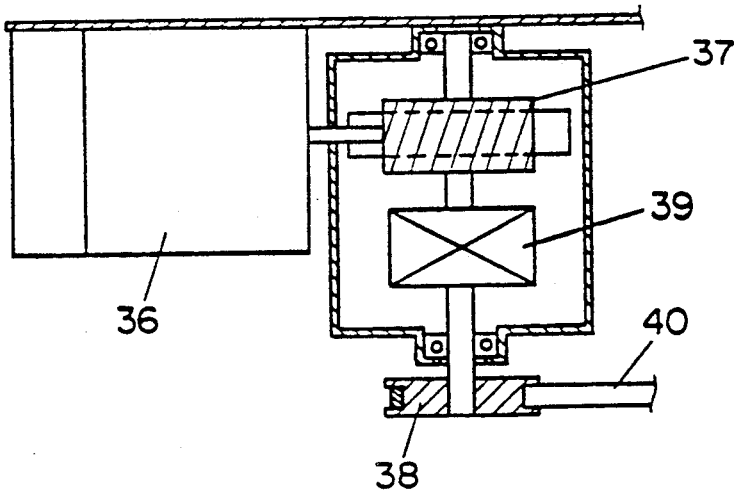
FIG. 6 is a sectional view showing a speed-reducing device of the same.

As shown in FIG. 6, numeral 36 designates a drying electric motor, numeral 37 a speed reduction gear consisting of a worm gear and worm wheel which is connected with the drying electric motor 36. Numeral 38 designates a drying pulley fitted on the drying electric motor 36, and the speed reduction gear 37 is connected to the drying pulley 38 with a connectable and releasable clutch 39. Numeral 40 designates a belt B for connecting the mechanical pulley 32 to the drying pulley 38. Numeral 41 designates an electric motor mount which is attached to the bottom surface of the water tub 18A and to which is secured the mechanical part 27, the washing electric motor 33 and the drying electric motor 36. Numeral 42 designates pillars, and numeral 43 tilting shafts arranged on the pillars 42 so as to be positioned at opposite diagonal corner parts of the main body 14. The pillars 42 are secured to the electric motor mount 41, and a unit including the electric motor mount 41, the tilting shafts 43, and the pillars 42 is called a support. Numeral 44 designates semicircular reinforcers fitted around the outside periphery of the water tub 18A and secured to the pillars 42 at both ends thereof; and numeral 45 designates pairs of suspensions for suspending the water tub, the support, etc. at the part of tilting shaft 43 from the main body A 14. Numeral 46 designates a base which is secured to the bottom surface of the main body 14 and to which are secured a blower 47, a heat exchanger 48 for condensation, and a tilting electric motor 49 for tilting the water tub.

Figure 7:
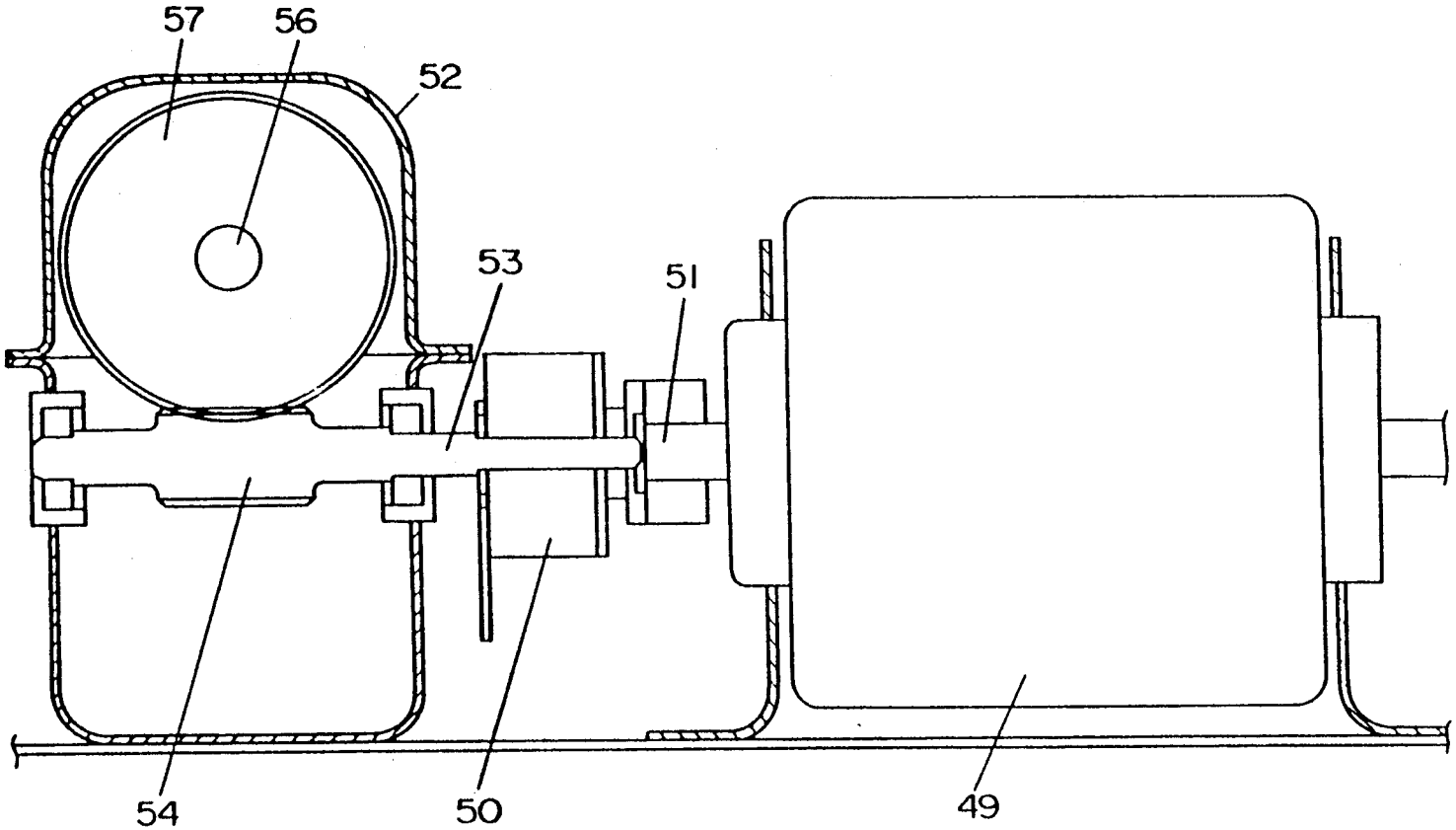
FIG. 7 is an enlarged cross sectional view showing a vicinity of a tilting speed reduction gear of the same.
Figure 8:
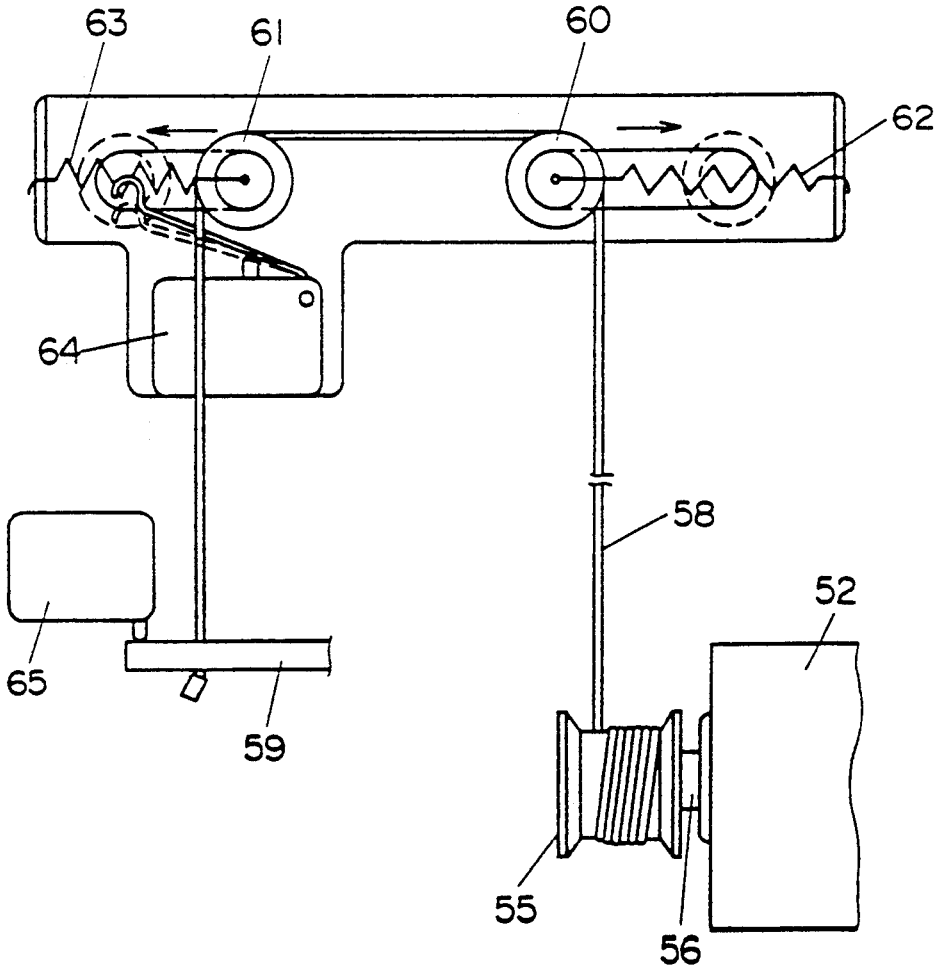
FIG. 8 is a schematic view showing a limit switch part.
Figure 9:
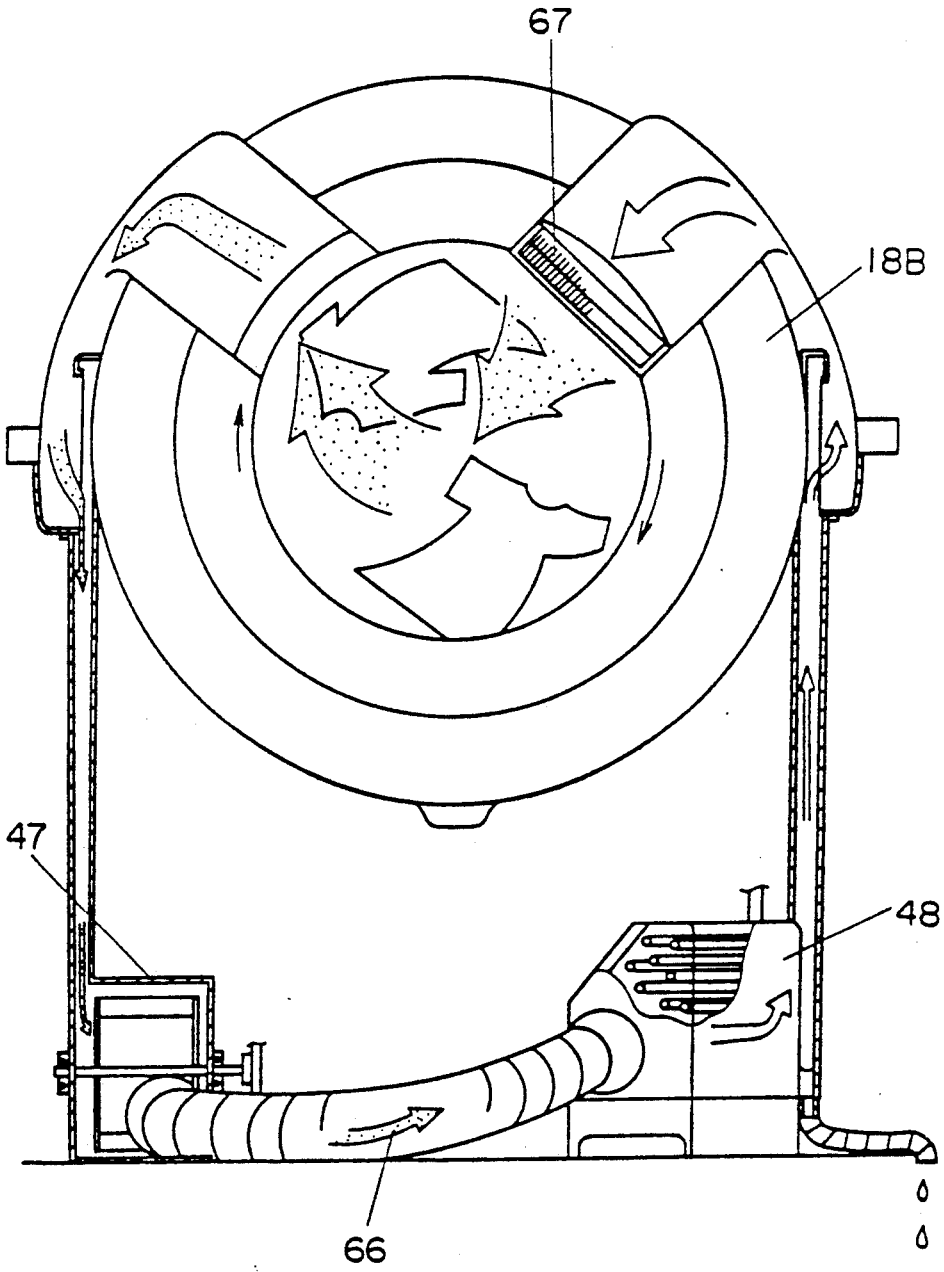
FIG. 9 is a diagrammatic view showing a flow of a drying air.
Figure 10:
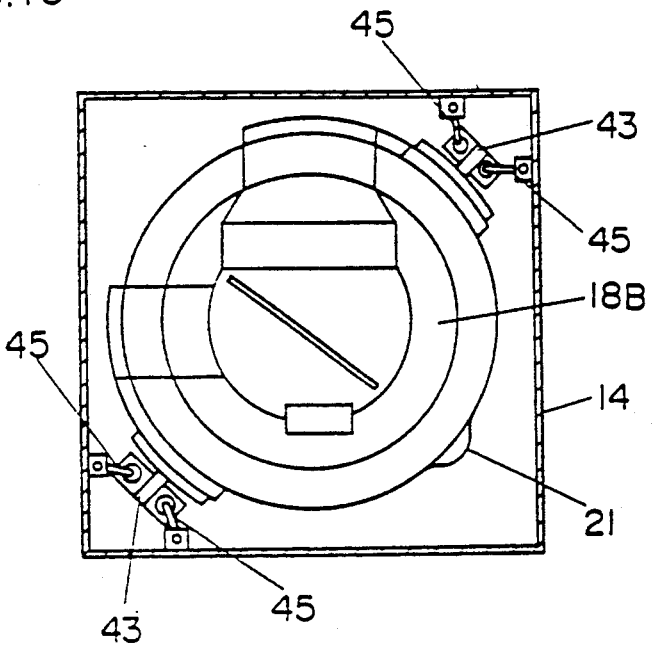
FIG. 10 is a horizontal sectional view showing the washing-drying machine during the washing-rinsing-spinning step.

FIG. 7 shows a tilting device, wherein numeral 50 designates a tilting clutch for connecting or releasing the output shaft 51 of the tilting electric motor to or from an input shaft 53 of a tilting speed reducing device 52. The tilting speed reducing device 52 is so designed that its input shaft 53 comprises a worm gear 54 which meshes with a worm sheel 57 arranged on an output shaft 56 of the tiling speed reducing device so as to reduce the speed. As shown in FIG. 8, a wire 58 has its end secured to a wire securing member 59 attached to the electric motor mount 41, and winds its way around a guide pulley 60 and a guide pulley 61 secured to the main body 14, so as to be wound up around a winding up pulley 55 secured to the above-mentioned shaft 56 of the tilting speed reducing device. The above-mentioned tilting speed reducing device 52 and the winding up pulley 55 compose the tilting device. The guide pulley 60 and the guide Pulley 61 are moved by a certain distance by the tension of the wire 58, and respectively have a spring 62 and a spring 63 for returning those pulleys to the initial positions when the tension of the wire 58 disappears. Numeral 64 designates a limit switch for detecting the vertical state of the water tub which is actuated by the guide pulley 61, and numeral 65 designates a limit switch for detecting the horizontal state of the water tub. Numeral 66 designates a fan duct which forms an airflow channel from the blowr 47 to the heat exchanger 48, and numeral 67 designates a heater which is arranged at the upper part 18B of the water tub 18A over a blowing-in port 68 for introducing drying air into the water tub, and communicates with a discharging duct 69 and a discharging duct 70 that are connected by a sliding part 71. The heater 67 communicates with the discharging duct 70 through an expandable and collapsible bellows 72. Numeral 73 designates an exhaust outlet for the drying air which is opened at the bottom surface of an inner lid 20 which is provided with a filter 74. Numeral 75 designates an intake duct communicating with an intake duct 77 through a sliding part 76; and an intake duct 77 communicates with a fan intake duct 79 through an expandable and collapsible bellows 78. By these configurations, as shown in FIG. 9, a circular course of the drying air from the blower 47 to the heat exchanger 48, and into the water tub 18A is circulated.

Numeral 80 designates a controlling device for controlling the washing electric motor 33. the mechanical part 27, the drying electric motor 36, the tilting electric motor 49, the heater 67, etc. Numeral 81 designates a laundry detecting means which is connected to the controlling device 80 and, in this embodiment, utilizes the change of the condenser terminal voltage of the washing electric motor 33 caused by the laundry amount in case of the driving of the pulsator 26 by the washing electric motor 33 during the washing step. That is, the water is supplied to the lower level, and the pulsator 26 is driven when the capacitor terminal voltage of the washing electric motor 33 is measured. to judge the laundry amount. Then, the water is supplied additionally according to the laundry amount, and the washing is started.

Figure 1:
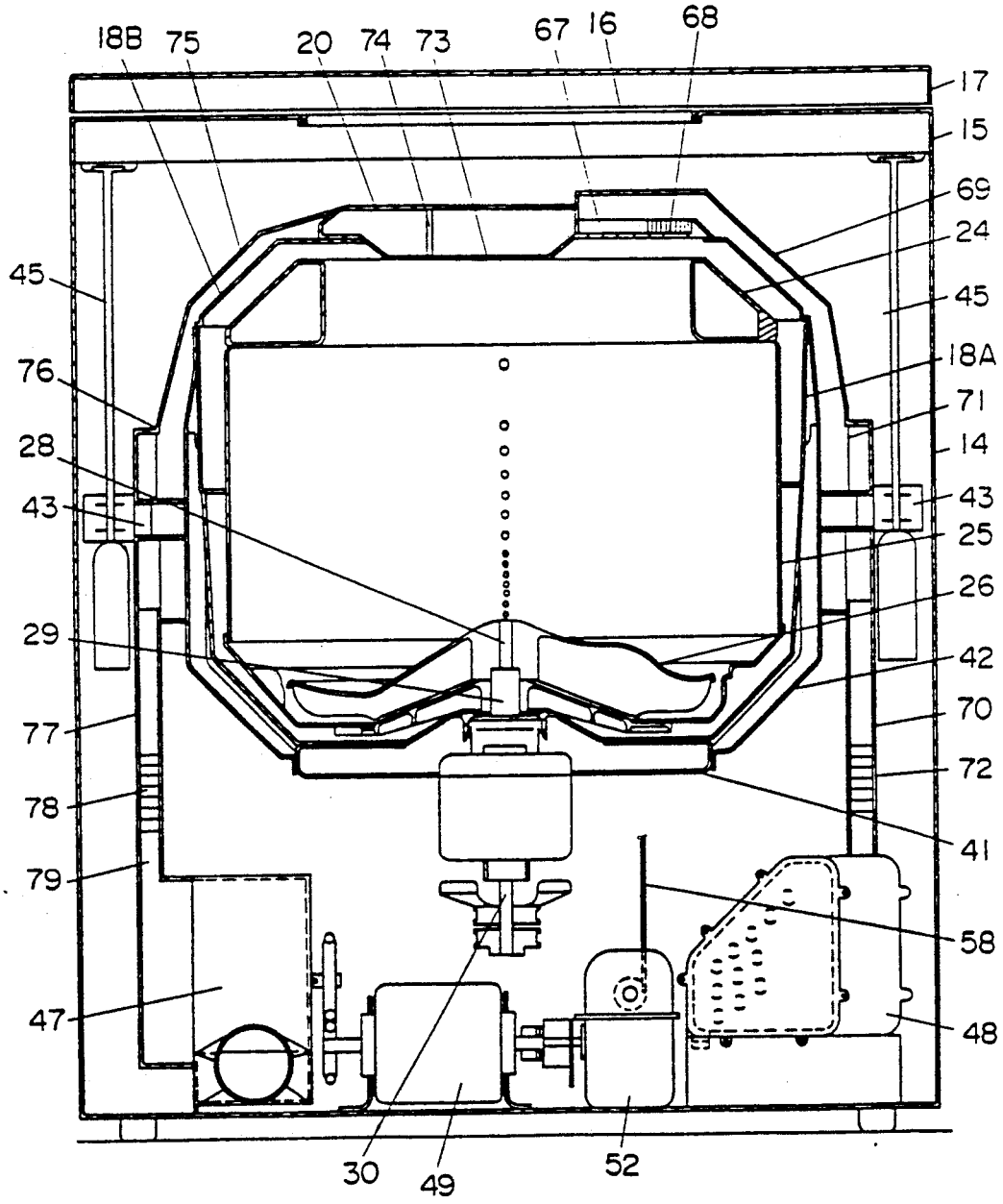
FIG. 1 is a longitudinally sectional view showing a washing-drying machine embodying the present invention in a vertical state.
Figure 2:
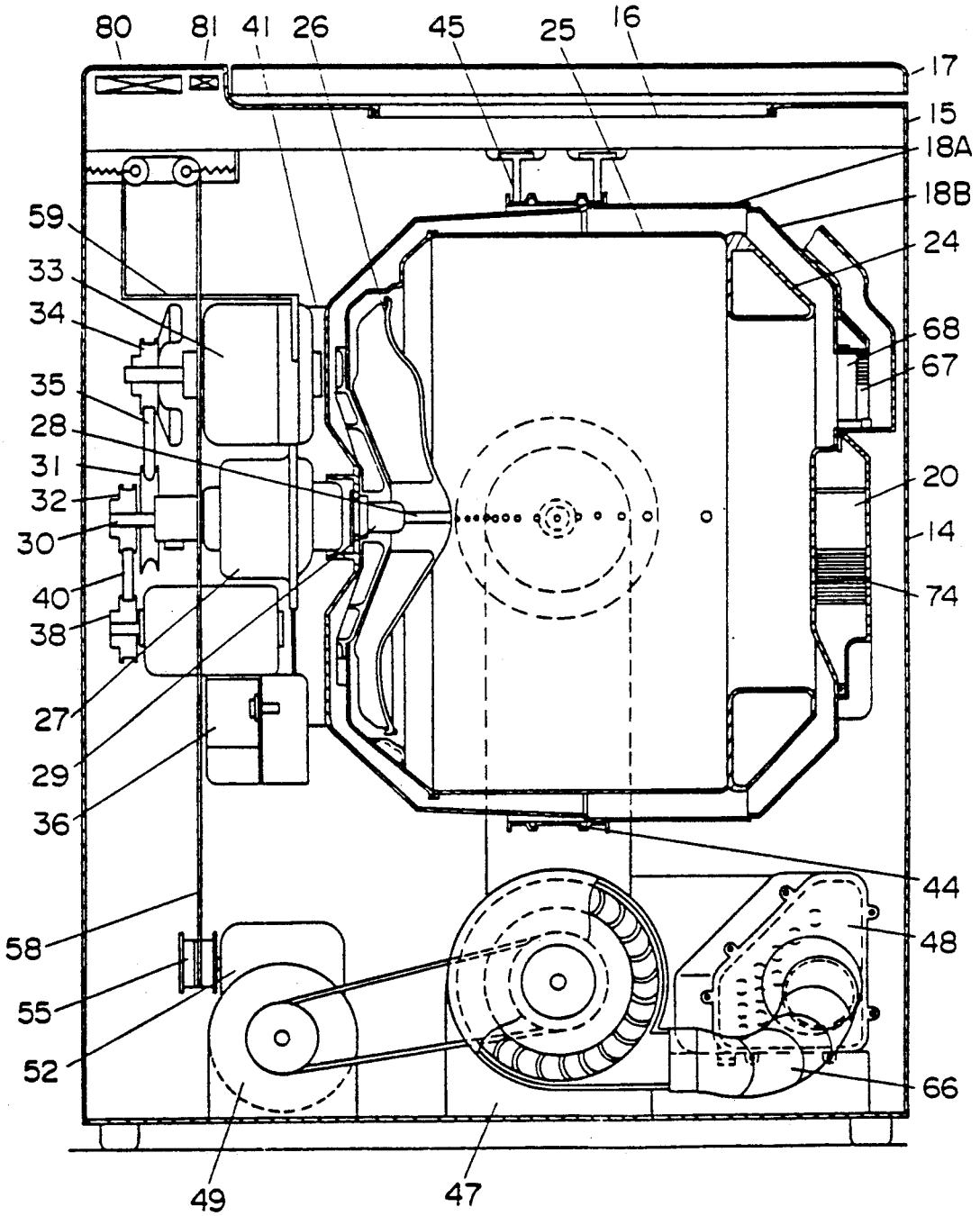
FIG. 2 is a longitudinally sectional view showing the same in a horizontal state.
Figure 3:
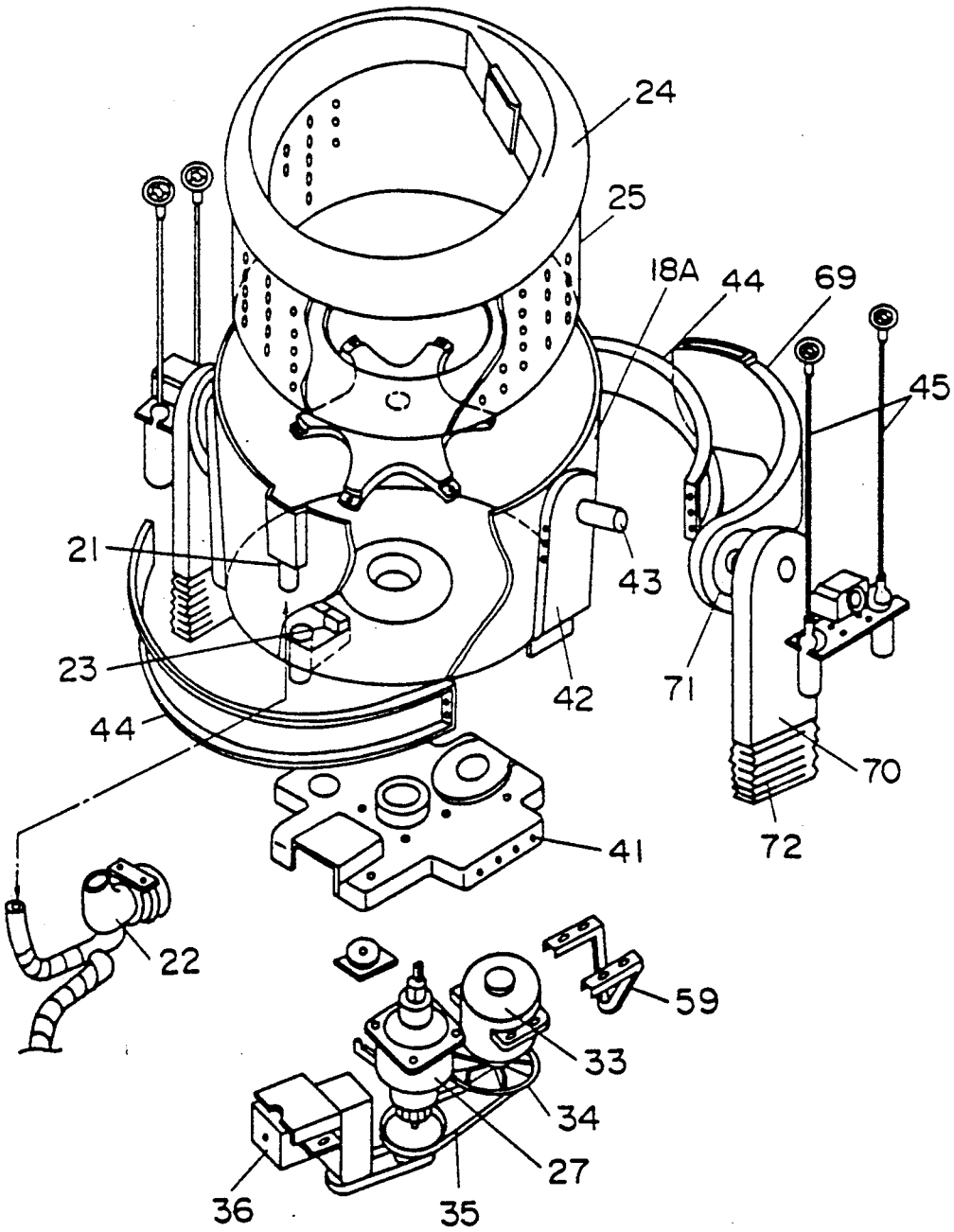
FIG. 3 is a perspective view partly broken away and showing the same.
Figure 4:
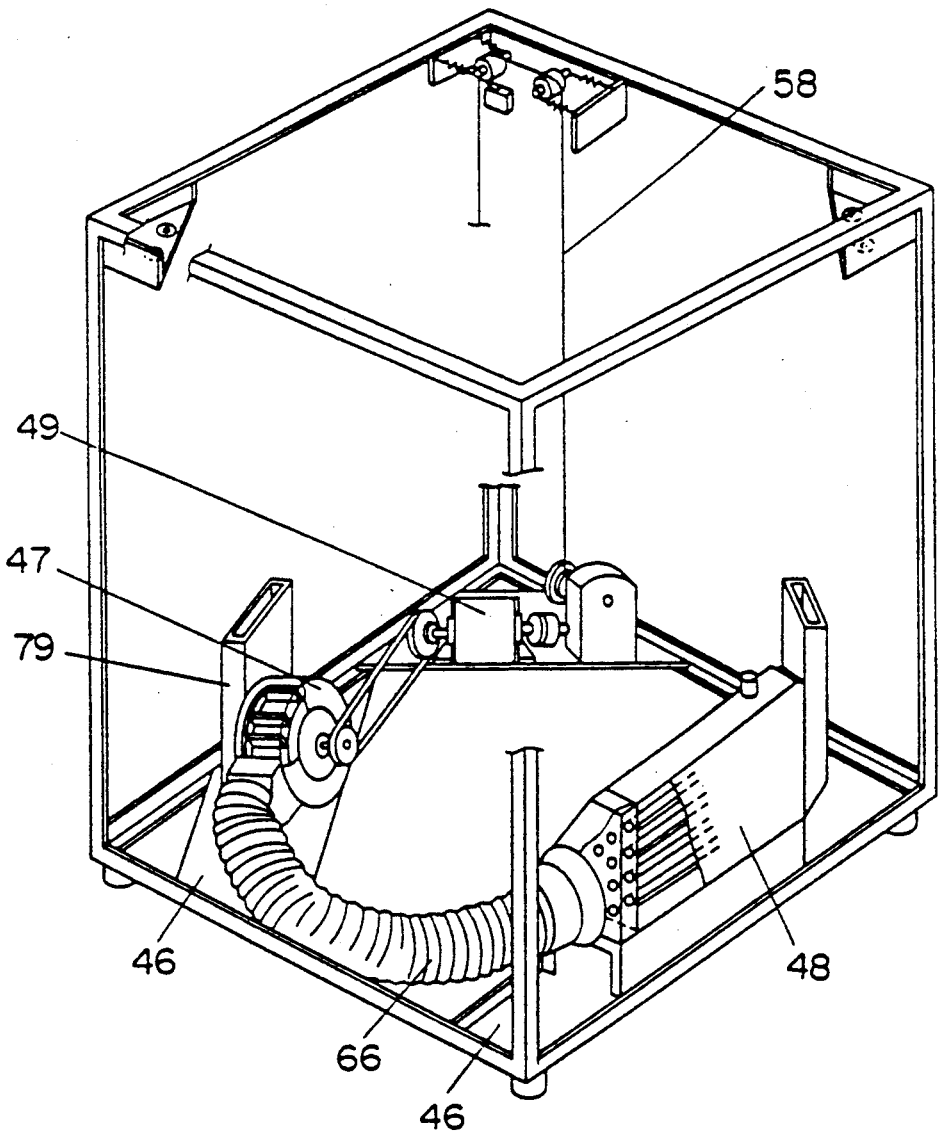
FIG. 4 is an opened-up view showing a bottom-part of the same.

Next, actions of an embodiment will be explained, FIG. 1 shows the state of the water tub during the washing-rinsing-spinning steps. During the washing-rinsing steps, the washing shaft 28 of the rotary drum is uprighted vertical when the pulsator 26, which is connected to the washing shaft 28 with the mechanical part 27, is rotated by the washing electric motor 33 in predetermined forward/backward cycles.

Figure 14:
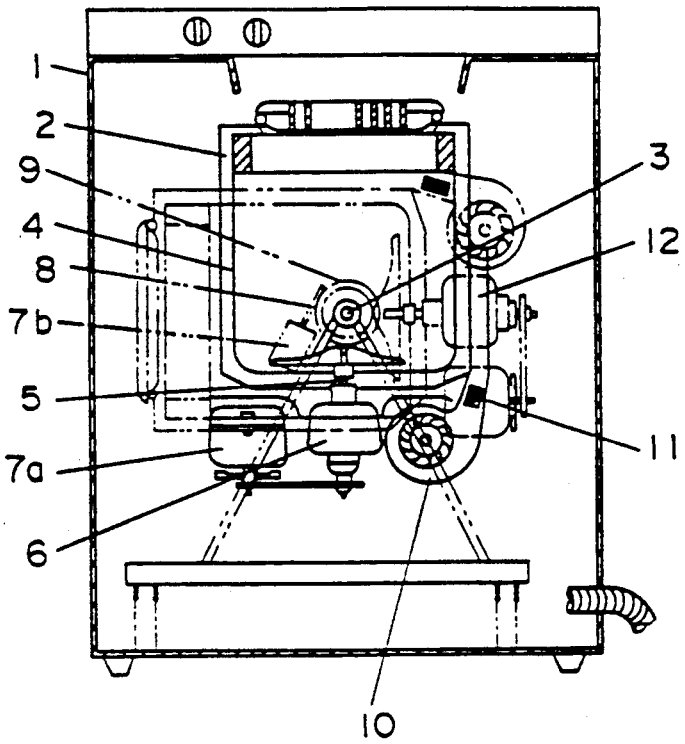
FIG. 14 (PRIOR ART)
FIG. 14 is the front sectional view showing the conventional washing-drying machine.
Figure 15:
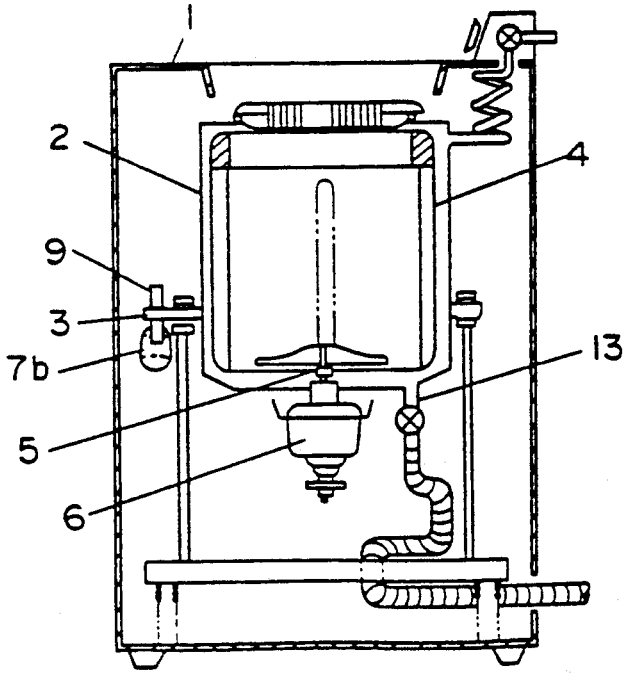
FIG. 15 (PRIOR ART)
FIG. 15 is the side sectional view showing the conventional washing-drying machine.

At that time, as mentioned above, the laundry detecting means 81 judges the laundry amount. The dryable laundry amount is about half of the washable amount of the same vessel capacity; namely, if the latter is 4 kg, the former is 2 kg. Therefore, if the laundry amount is judged in excess of the predetermined limit, i.e., 2 kg, the controlling device 80 carries out only the washing-rinsing-spinning steps, and then gives notice of "the washing finished" to uniform the user (the first through the 5th steps of FIG. 14(sic)). If the user wishes to proceed and finish the drying, he or she takes away a part of the laundry and carries out the drying. If the laundry amount is less than the predetermined limit, i.e., 2 kg, the drying step succeeding the washing-rinsing-spinning step is carried out when notice of "the drying finished" is given (the 4th, step, and the 6th through 9th steps of FIG. 14(sic)). Though, during the washing step, the water tub is filled with water for washing, the water tub 18A has been fittingly secured to the upper port 18B with the sealing member 19, which prevents the water from leaking out, affording a very high reliability. During the spinning step, the rotary drum 25 is connected to the spinning shaft 29 with the mechanical part 27 and rotated at a high speed of about 800 rpm so as to dewater the laundry. During that time, the vibration of the rotary drum 25 is transferred to the suspensions 45 through the water tub 18A and the tilting shafts 43, to be damped there. During the washing-rinsing-spinning steps, the speed reduction gear 37 is disconnected from the drying pulley 38 with the clutch 39. Hence, the rotation of the washing electric motor 33 is not transferred to the speed reduction gear 37 and the drying electric motor 36, whereby the drives of the pulsator 26 and the rotary drum 25 is not hindered.

In case there is any probability that some water remains in the water tub 18A as in case of carrying out the drying only, the controlling device 80 carries out the spinning before the tilting of the water tub when the drying step is directly started. By doing this, the laundry has been dewatered when the water tub is tilted, and no water remains in the water tub, and a very high reliability free of water leakage during the tilting is afforded.

Figure 11:
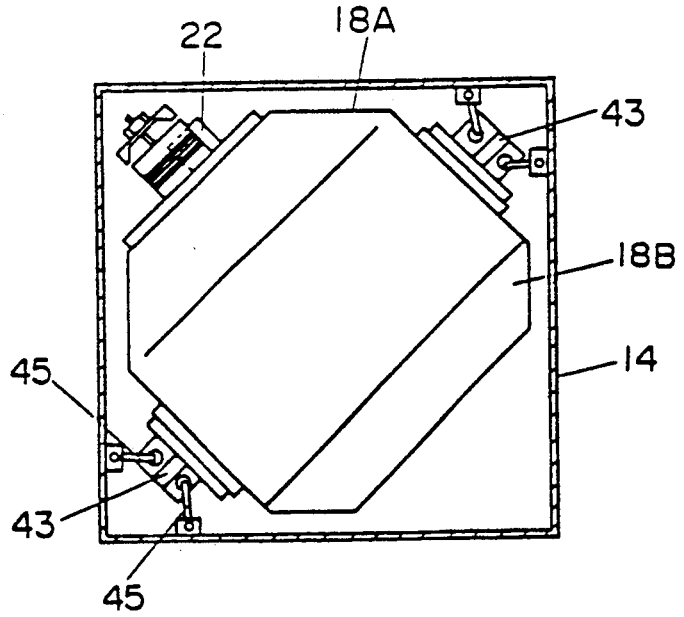
FIG. 11 is a horizontal sectional view showing the washing-drying machine during the drying step.
Figure 12:
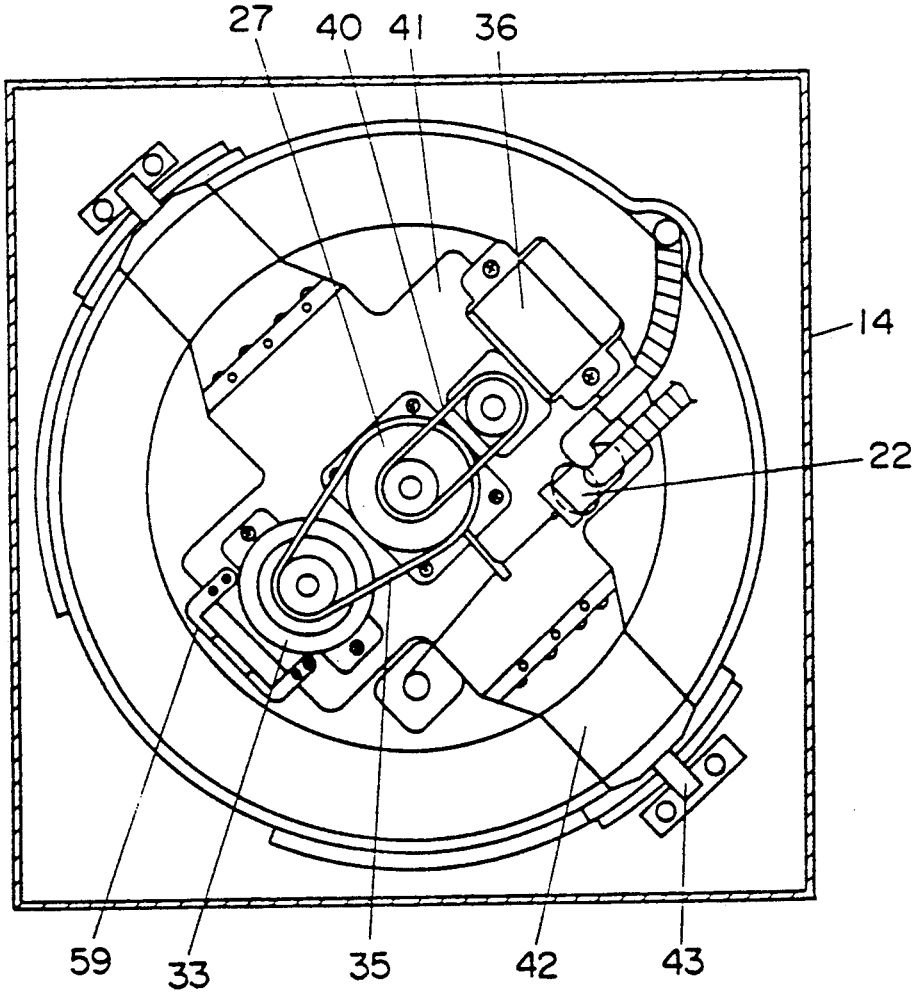
FIG. 12 is an enlarged sectional view showing a bottom part of the water tub of the washing-drying machine.
Figure 13:
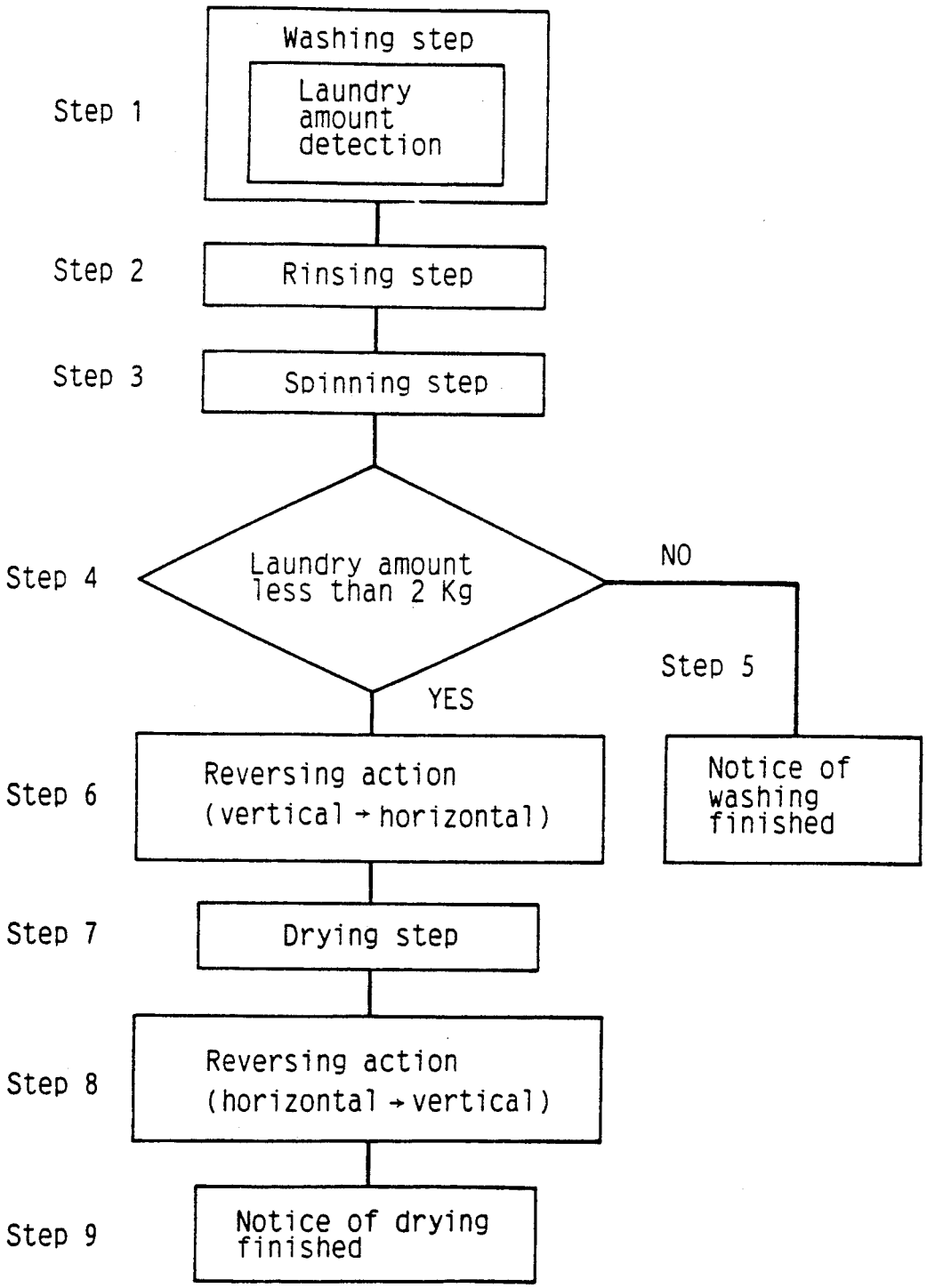
FIG. 13 is a flow chart showing actions of the washing-drying machine.

Further, in case the remaining water detector 23 confirms no water remaining in the water tub 18A when proceeding to the drying step, namely when the resistance between the electrodes of the remaining water detector 23 exceeds the predetermined limit, the water tub is tilted. Hence, in case any water remains in the water tub 18, the water tub is never tilted, affording a very high reliability. The tilting is carried out by that the tilting clutch is connected, the tilting electric motor is driven, and the winding up pulley 55 secured to the output shaft 56 of the tilting speed reduction gear winds up the wire 58, whereby the water tub is gradually tilted around the tilting shafts 43. When the water tub becomes horizontal, the limit switch 65 is actuated so as to stop the tilting electric motor 49. Then the guide pulley 61 is moved by the tension of the wire 58, to release the limit switch 64. During the above-mentioned tilting, since the tilting shafts 43 are arranged at the corner parts of the main body 14, the size of the water tub can be maximized in spite of its tilting, and the capacity of the main body can be effectively utilized. Further, since the bottom part 18B and the upper part of the water tub 18A and the water tub B 18B and the water tub B 18B are formed in truncated-cones, they can get rid of interference with the side walls of the main body 14, and the capacity of the main body 14 can effectively be utilized, thereby to maximize the water tub capacity. Since, as shown in FIG. 11 and FIG. 12, the water outlet 22 is arranged so as to be positioned at the corner part of the main body 14 in case the water tub is horizontal and the overflow outlet 21 is arranged at the corner part of the main body 14, the orbits of the water outlet 22 and the overflow outlet 21 during the tilting pass through the cornering parts of the main body 14, and the capacity of the main body 14 can be effectively utilized thereby to enlarge the water tub.

Next, in the drying step, the tilting clutch 50 is released, and the blower 36 alone is driven by the tilting electric motor 49. At the same time, the drying electric motor is driven, and the speed reduction gear 37 is connected to the drying pulley 38 with the clutch 39. The rotation speed of the drying electric motor 36 is decelerated to about 60 rpm by the speed reduction gear 37, and also the torque is increased. Hence, even a small electric motor can afford a great torque, and no complicated controlling device is needed to obtain a low speed. The rotary drum 25 begins to be rotated at a predetermined speed of about 60 rpm with the belt B 40 by the drying electric motor 36, so as to roll the laundry in the rotary drum 25. The drying air heated by the heater 67 is blown into the water tub through the blowing-in port 68, to dry the laundry. Air which has become much humid after drying the laundry goes through the exhaust outlet 73 and via a lint filter 74 to the heat exchanger 48, and is dehumidified, and thereafter returns to the blower. In this way, the air dries the laundry circuiting the course for the drying air. During this time, the cooling water for water-cooling the heat exchanger is timely supplied from the city water.

Since the heater 67, the blowing-in port 68 for introducing the air in the water tub, and the exhaust outlet 73 are arranged at the upper part of the water tub, no water splashes the heater 67, nor water encroaches the course for the drying air, thereby offering a reliability of high safety free of electricity leakage and water leakage; and further since the air for drying is blown in the rotary drum 25 instantaneously after being heated, it very efficiently dries the laundry. Next, when the drying step is finished, the rotary drum 25 is stopped, the tilting clutch 50 is connected and the tilting electric motor 49 reversely rotates, to unwind the wire 58 which has been wound up around the winding up pulley 65. When the water tub 18A is uprighted vertical, the tension of the wire 58 is such reduced that the guide pulley A 60 is returned to the initial position by the spring A 62, to actuate the limit switch A 64, which stops the tilting electric motor 49. In the above-mentioned manner, a series of steps from washing to drying is carried out.

INDUSTRIAL APPLICABILITY

As has been described, the present invention arranges the tilting shafts at the cornering parts of the washing machine main body, whereby it can wash a certain amount of laundry without enlarging the size of the main body of washing machine.

Further, the present invention is that a pair of tilting shafts are arranged at the diagonal corners of the main body and a water outlet is arranged in the vicinity of the corner part of the main body; and when the water tub almost horizontal, and arranges an overflow outlet in the vicinity of the cornering part of the main body, whereby the orbits of the water outlet and the overflow outlet during the tilting pass through the cornering parts of the main body, and the capacity of the main body can be utilized efficiently and the water tub can be made large.

Moreover, the present invention arranges the pair of tilting shafts at the diagonal corners of the main body, and made the water tub almost cylindrical having the upper part and bottom part thereof formed almost as truncated-cone, and thereby the orbit of the water tub during the tilting is made small, and the water tub can be made large.

Further, since the present invention provides a blowing-in port and an exhaust port at the upper part of the water tub, no water splashes the heater nor water encroaches the circulating air course, thereby offering a reliability of high safety free of electricity leakage and water leakage.

Further, the present invention has a controlling device which carries out the washing-rinsing spinning step in the almost vertical state of the water tub and carriers out the drying step in the almost horizontal state of the water tub and carries out the spinning step before the driving of the tilting device, whereby even when the water remains in the water tub before the tilting the water is removed by the spinning, and no water leaks during the tilting, thereby a high reliability can be offered.

Moreover, the present invention has a laundry amount detecting means for detecting the laundry amount before the drying step and the controlling device, and stops the step to the drying by the controlling device when exceeding of the laundry amount above the predetermined limit is detected, whereby the user need not judge before starting the washing whether he or she must carry out only the washing-rinsing-spinning step or she can continue until the drying step depending on the laundry amount, and it gives conveniences.

We claim:

1. A washing-drying machine for laundry having a washing cycle, a rinsing cycle, a spin-drying cycle and a warm-air tumble drying cycle, comprising:

a prism-shaped housing;

a tub in said housing;

a perforated rotary drum in said tub for holding laundry:

an oscillating pulsator in said drum for washing laundry; pivot means secured to opposite sides of said tub and to said housing for rotary movement of said tub about a substantially horizontal axis extending substantially through diagonally opposite corners of said housing, between a substantially vertical position for washing, rinsing and spin-drying cycles and a substantially horizontal position for a warm-air tumble drying cycle;

means for rotating said tub between said positions;

means defining a path for warm-drying air including said drum, a heater and a blower;

an upward-opening overflow outlet on a side of said tub arranged to be in the vicinity of a corner of said housing when said tub is substantially vertical; and a water outlet in communication with said overflow outlet, mounted to the underside of said tub and arranged to be positioned in the vicinity of a corner of said housing when said tub is substantially vertical.

2. A washing-drying machine for laundry having a washing cycle, a rinsing cycle, a spin-drying cycle and a warm-air tumble drying cycle, comprising:

a prism-shaped housing;

a tub in said housing;

a perforated rotary drum in said tub for holding laundry;

an oscillating pulsator in said drum for washing laundry;

pivot means secured to opposite sides of said tub and to said housing for rotary movement of said tub, about a substantially horizontal axis extending substantially through diagonally opposite corners of said housing, between a substantially vertical position for washing, rinsing and spin-drying cycles and a substantially horizontal position for a warm-air tumble-drying cycle;

means for rotating said tub between said positions;

means defining a path for warm-drying air including said drum, a heater and a blower; and a control device which carries out said washing, rinsing and spin-drying cycles with said tub substantially vertical, which actuates said rotating means on completion of said cycles to rotate said tub from said vertical position to said horizontal position and for carrying out said warm-air tumble drying cycle, and which includes means for detecting the amount of laundry in said tub and for stopping rotation of said tub from said vertical position to said horizontal position and stopping said warm-air tumble drying cycle when the amount of laundry detected exceeds a predetermined amount.

3. A washing-drying machined for laundry having a washing cycle, a rinsing cycle, a spin-drying cycle and a warm-air tumble drying cycle, comprising:

a prism-drying housing;

a tub in said housing;

a perforated rotary drum in said tub for holding laundry;

an oscillating pulsator in said drum for washing laundry;

pivot means secured to opposite sides of said tub and to said housing for rotary movement of said tub, about a substantially horizontal axis extending substantially through diagonally opposite corners of said housing, between a substantially vertical position for washing, rinsing and spin-drying cycles and a substantially horizontal position for a warm-air tumble drying cycle;

means for rotating said tub between said positions;

means defining a path for warm-drying air including said drum, a heater and a blower; and a control device for carrying out said washing, rinsing and spin-drying cycles with said tub substantially vertical, for actuating said rotating means on completion of said cycles to rotate said tub from said vertical position to said horizontal position and for carrying out said warm-air tumble drying cycle, and for carrying out said spin-drying cycle before actuation of said rotating means to rotate said tub to said horizontal position for said warm-air tumble drying cycle, said control device including means for indicating whether or not any water remains in said tub after said spin-drying cycle has been carried out and for preventing actuation of said rotating means if any water remains in said tub.

* * * * *

UNITED STATES PATENT AND TRADEMARK OFFICE

CERTIFICATE OF CORRECTION

PATENT NO. : 5,111,673

DATED : May 12, 1992

INVENTOR(S) : KADOYA, et al.

It is certified that error appears in the above-identified patent and that said Letters Patent is hereby corrected as shown below:

On the Title Page

[30] Foreign Application Priority Data

The fifth-listed document should read --

June 20, 1988 [JP] Japan 63-152628

Signed and Sealed this

Twenty-sixth Day of April, 1994

*Attest:*

*Attesting Officer*

Bruce Lehman

BRUCE LEHMAN

*Commissioner of Patents and Trademarks*